United States Patent [19]

Chrtek et al.

[11] 4,112,663

[45] Sep. 12, 1978

[54] METHOD OF AND APPARATUS FOR COOLING SPINNING UNITS OF OPEN-END SPINNING MACHINES

[75] Inventors: Milan Chrtek, Ceska Trebova; Josef Gábler; Frantisek Tůma, both of Usti nad Orlici; Karel Kašpárek, Zachlumi; Ján Blaško, Usti nad Orlici, all of Czechoslovakia

[73] Assignee: Vyzkumny ustav bavlnarsky, Usti nad Orlici, Czechoslovakia

[21] Appl. No.: 807,003

[22] Filed: Jun. 16, 1977

[30] Foreign Application Priority Data

Jul. 6, 1976 [CS] Czechoslovakia ..... 4456/76

[51] Int. Cl.[2] ..... D01H 1/12

[52] U.S. Cl. ..... 57/58.89; 57/100

[58] Field of Search ..... 57/58.95, 101, 34 R, 57/58.89, 100; 310/59, 61

[56] References Cited

U.S. PATENT DOCUMENTS

| | | | |
|---|---|---|---|
| 3,158,768 | 11/1964 | Schönwald | 57/100 X |
| 3,667,870 | 6/1972 | Yoshida et al. | 310/61 X |
| 3,747,998 | 7/1973 | Klein et al. | 57/58.89 UX |
| 3,875,732 | 4/1975 | Ellingham | 57/58.89 |
| 3,882,335 | 5/1975 | Fries | 310/61 |
| 3,924,398 | 12/1975 | Esser | 57/58.89 |
| 3,934,396 | 1/1976 | Stahlecker et al. | 57/58.89 |
| 3,972,171 | 8/1976 | Handschurch et al. | 57/58.89 |

FOREIGN PATENT DOCUMENTS

| | | | |
|---|---|---|---|
| 1,085,184 | 9/1967 | United Kingdom | 57/58.89 |

*Primary Examiner*—Donald Watkins

[57] ABSTRACT

Method of and apparatus for cooling the spinning units of open-end spinning machines driven by individual high speed electric motors. A cooling air flow is separated from the technological air flow, such cooling air flow being introduced into the housing of each unit in the space between the rotor of its motor and the spinning rotor connected thereto and dividing into two flows. One such flow travels between the stator and rotor of the motor; the other flow travels within the unit housing radially outwardly of the stator of the motor.

5 Claims, 2 Drawing Figures

METHOD OF AND APPARATUS FOR COOLING SPINNING UNITS OF OPEN-END SPINNING MACHINES

Figure 1:
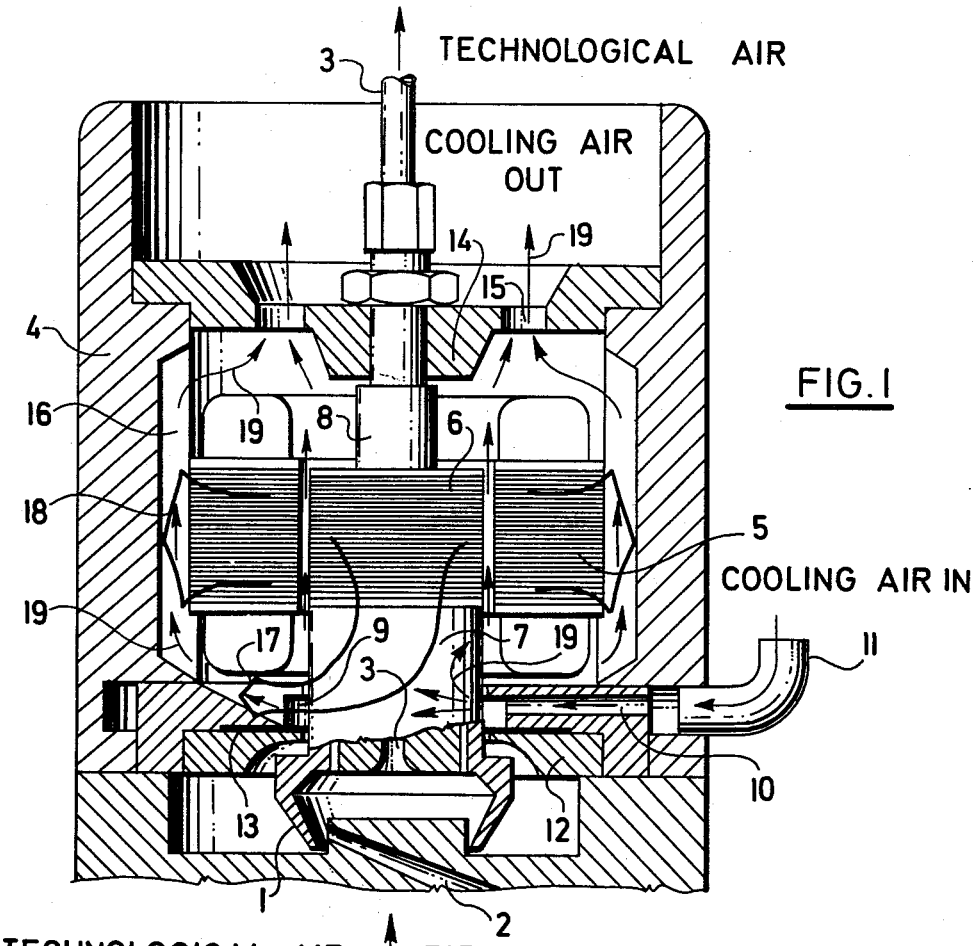

This invention relates to the cooling of spinning units of open-end spinning machines in which each spinning rotor is individually driven by a high-speed, e.g. high-frequency, electric motor.

The power required for the driving of all the operating mechanisms of an open-end spinning machine constitutes only a small, even practically negligible part of the total energy supplied to the machine. Friction in the bearings as well as in other operating and gearing mechanisms, power losses in motors, transformers or the like, ventilation losses in the drive mechanisms and in the spinning rotor, and other losses, result in an essential part of this energy being converted into heat.

In open-end spinning machines operating at speeds not exceeding 50,000 rpm, all the spinning rotors are driven, as a rule, in common as, for example, by a belt drive, the driving motor and transmission mechanisms being housed in a drive box which is separate from the spinning units. In such an arrangement, the drive means do not thermally affect the spinning units so that it is sufficient to cool them by the so-called technological air. This is air sucked into the interior of the spinning rotor by reason of its rotation, from the housing of fiber separating device via supply duct together with the separated fibers, on the one hand, and on the other hand, from the spinning mill room via the yarn take-off tube through which yarn is withdrawn from the spinning rotor. The drive box is separately cooled by connecting it to the air conditioning system for the spinning mill.

However, in open-end machines in which the spinning rotors operate at a speed of more than 50,000 rpm, it is necessary to use an individual drive for each spinning rotor by means of a high-speed, e.g. high-frequency electric motor which is built into the housing of the spinning unit. In this case, the spinning unit is so thermally influenced by energy losses in the driving mechanisms that the technological air is not sufficient to cool it.

An additional system for cooling spinning units by cooling air flow separated from the technological air is known. However, this known system is not satisfactory, since the additional cooling air thereof acts mainly on the spinning rotor where the minimum heat gradient prevails, while the spinning rotor is sufficiently cooled by the technological air, whereas in the vicinity of the electric motor, bearings etc., the cooling is insufficient. Apart from this, the cooling air cannot be prevented from penetrating into the technological air and vice versa, whereby the stability of the technological process may be adversely affected.

It is an object of the present invention to eliminate the disadvantages of the prior art as hereinabove set forth, and to provide an additional system of cooling the spinning units of open-end spinning machines operating with individually driven spinning rotors which are directly connected to the rotors of respective high-speed electric motors.

This cooling system is effective, operates with a minimum power consumption, and does not affect the technological process of spinning.

In accordance with the method of this invention, the cooling air flow is separated from the technological air flow. The cooling air is conveyed into the interior of the housing of the spinning unit and into the space between the spinning rotor and the rotor of said electric motor. The cooling air leaves said space away from the spinning rotor in the form of two flows, one of which bypasses the rotor of the electric motor in the space between said rotor and the stator, while the other flow bypasses the jacket of the stator and is withdrawn, downstream of the motor, out of the spinning unit housing.

The invention includes an apparatus for carrying out the method. In such apparatus, an electric motor is associated with the spinning unit accommodated in the housing. The rotor of the electric motor is coupled with the spinning rotor by means of a common hub disposed in the space which is sealed relative to the interior of the spinning rotor, the housing downstream of the electric motor at the side opposite the spinning rotor, being closed by a cover. In accordance with the invention, the wall of the housing is pierced by a nozzle or a nozzle system connected to a supply of cooling air, the nozzle or nozzles being open to the interior of the housing in the direction towards the hub in the space between the spinning rotor and the electric motor; said space communicates, at least via a spacing between the rotor and the stator of the electric motor. Outlet apertures for withdrawing cooling air are provided in the cover of the housing.

In a preferred embodiment, the inner space of the spinning unit housing also communicates with the outlet apertures via by-pass conduits provided in the wall of the housing around the jacket of the stator.

By directing the air flow against the hub, which is intensely cooled thereby, and by subsequently conveying the cooling air in a direction counter to the heat flow, a predominant portion of the heat is withdrawn from the spinning rotor. By conveying the air through the space between the rotor and the stator, both the rotor and the inner surface of the stator are cooled. By conveying the air through the by-pass ducts, the outer surface of the stator and the wall of the housing are cooled. At the outlet portion of the housing, the cooling air cools the cover.

It is an advantage of the invention that an effective cooling is achieved in those regions where a predominant portion of the heat is generated and from which heat intensively travels towards colder regions. An especially advantageous feature of the invention is the direction of the cooling air flow in the direction counter to the heat flow.

Figure 2:
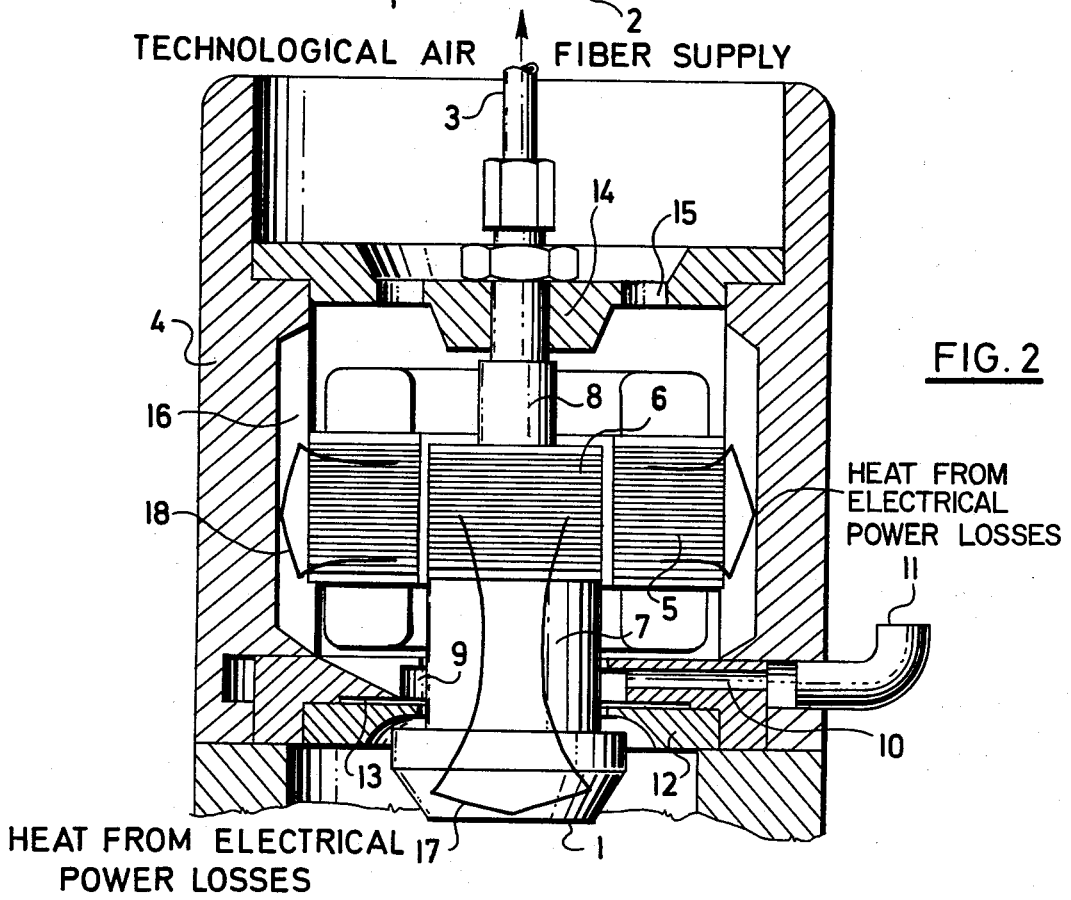

In order that the invention may be better understood and carried into practice, a preferred embodiment thereof is illustrated in the accompanying drawings, in which:

FIG. 1 is a schematic vertical sectional view of the upper part of an open-end spinning unit provided with the apparatus of the invention, in which the flow lines of the cooling air and the direction of heat flow influenced by the cooling air flow are shown, the unit being in operation and cooled, and FIG. 2 is a similar view of the spinning unit wherein the directions of heat propagation or build up in an uncooled spinning unit are indicated.

As it can be seen in the drawings, and particularly in FIG. 1, the main operating element of an open-end spinning unit is a spinning rotor 1 into the interior of which there are supplied separated fibers via a supply duct 2, the fibers coming from a fiber separating device (not shown). The fibers are converted in the spinning rotor 1 to yarn which is then withdrawn through a take-off duct 3 and is wound onto a bobbin (not shown). Owing to the rotation of the spinning rotor 1, the so-called technological air is sucked thereinto, viz. on the one hand, there is a fiber transporting air flow through the supply duct 2 and, on the other hand, air from the ambient spinning mill atmosphere flows through the take-off duct 3 which extends through the rotor of the motor, as shown.

In the spinning unit housing, indicated by the reference numeral 4, there is a built in high speed (high frequency) electric motor, the motor comprising a stator 5 installed in the wall of the housing 4, and a rotor 6 secured to a hub 7 which also constitutes the hub of the spinning rotor 1. The hub 7 is mounted on and rotates with a hollow shaft 8 through which the yarn take-off duct 3 extends.

In the housing 4 there is provided an annular space 9 between the spinning rotor 1 and the electric motor. A nozzle 10 or system of nozzles open into space 9 opposite the hub 7; the nozzle 10 or nozzles are connected to a cooling air supply via a supply pipe 11. The space 9 is sealed relative to the spinning rotor interior from below by a sealing ring 12 and a gasket 13, the latter bearing upon the hub 7. In this manner, the cooling air flow is separated from the afore-mentioned technological air.

On its top side, i.e. on the side opposite the spinning rotor 1, the housing 4 is provided with a cover 14 having outlet apertures 15 therein for withdrawing the cooling air. The aforesaid inner space 9 of the spinning unit housing 4 communicates with the outlet apertures 15, on the one hand, via a spacing or gap between the rotor 6 and the stator 5 and, on the other hand, via by-pass conduits 16 provided in the wall of the housing 4 radially outward of the jacket of the stator 5.

As illustrated in FIG. 2, the heat generated, above all, in the spinning unit owing the electric power losses in the motor, and by friction, is transmitted by convection, on the one hand, from the rotor 6 through the hub 7 downwards to the spinning rotor 1 in the direction of arrow 17 and, on the other hand, from the stator 5 into the housing 4 in the direction of the broad-headed radial arrows 18.

The flow directions of the air supplied through the supply pipe 11 are indicated in FIG. 1 by flow lines 19. The cooling air is discharged by the nozzle 10 or a nozzle system against the hub 7 and its flow is divided into two branches, one of which is directed upward and passes through the spacing between the rotor 6 and the stator 5, while the other is conveyed via the by-pass conduits 16 around the stator jacket. The two branches join above the electric motor and the cooling air leaves the housing 4 through the outlet apertures 15 in the cover 14, either immediately into the spinning mill atmosphere, or is recirculated via a pipeline (not shown) back into an air conditioning (cooling and treating) device.

Due to the intense cooling of the hub 7 and the conveying of the cooling air upwards, i.e. opposite the direction of heat flow, a predominant portion of the heat is withdrawn from the spinning rotor 1. In FIG. 1, the apparent change of the direction of heat flow above the spinning chamber 1, relative to that shown in FIG. 2, is indicated by the arrow 17.

Both the rotor 6 and the inner surface of the stator 5 are cooled by conveying the air through the spacing between the rotor 6 and the stator 5. Both the outer surface of the stator 5 and the wall of the housing 4 are cooled by conveying the air through the by-pass conduits 16. The cooling air cools the cover 14 at the outlet portion of the housing 4.

It is an advantage of the present invention that the open-end spinning unit is efficiently cooled in those regions where a predominant amount of heat is generated and from which heat intensely travels to the colder regions of the apparatus. Especially advantageous is the conveying of the cooling air in a direction counter to the heat flow.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. A method of cooling the spinning units of an open-end spinning machine, the units each having a spinning rotor, each spinning unit having an individual housing and a high-speed electric motor the rotor of which is directly connected to the spinning rotor, there being a technological air flow accompanying the flow of fibers in and through the spinning rotor of the unit, comprising introducing cooling air into the space in the housings of the units between the rotor of the motor and the spinning rotor of each unit, maintaining a cooling air separate from the technological air in each unit, and causing the cooling air which leaves said space to travel in the form of two flows, one of which by-passes the rotor of the electric motor in the space between said rotor and the stator, the other of said flows passing the stator radially outwardly thereof, and withdrawing both flows, downstream of the motor, out of the housing of the spinning unit.

2. In an open-end spinning apparatus having a spinning unit with a spinning rotor and a housing therefore, a high-speed electric motor disposed in the housing, the rotor of the electric motor being directly coupled with the spinning rotor, there being a technological air flow into and through the spinning rotor of the unit, the improvement which comprises a hub connecting the rotor of the motor to the spinning rotor, means sealing the hub to the housing to isolate the motor from the interior of the spinning rotor, a supply of cooling air, means to supply said cooling air into the space within the housing downstream of said sealing means, means to conduct the thus fed cooling air to the gap between the rotor and stator of the motor, means to conduct the air issuing from such gap outwardly of the housing, a plurality of longitudinally extending by-pass passages in the housing directly communicating with the radially outer surface of the stator of the motor, and means connecting the space within the housing between the rotor of the motor and the spinning rotor which receives cooling air with the adjacent ends of the longitudinally extending by-pass passages, said by-pass passages communicating at their other ends with air-discharging openings through the wall of the housing.

3. Apparatus according to claim 2, wherein the sealing means comprises an annular gasket, the radially outer portion of the gasket being fixedly mounted within the housing, the hub passing through the gasket and sealingly engaging the inner rim thereof.

4. Apparatus according to claim 2, wherein the means for introducing cooling air into the housing comprises a conduit connecting the source of cooling air to the housing, a generally radially inwardly directed passage in the housing connecting the conduit to the space in the housing between the rotor of the motor and the spinning rotor and directing cooling air against the hub downstream of the sealing means, and means conducting the thus introduced cooling air into the upstream end of the gap between the rotor and stator of the motor.

5. Apparatus according to claim 2, wherein the housing has a cover at the end thereof remote from the spinning rotor, the cover has a plurality of openings therethrough, and the flow of air through the gap between the rotor and stator of the motor and the flow of air through the longitudinally disposed by-pass passages travel out of the housing through said openings in the cover thereof.

* * * * *